US005972137A

United States Patent [19]

Wypkema et al.

[11] Patent Number: 5,972,137

[45] **Date of Patent: *Oct. 26, 1999**

[54] EXPLOSIVES

[75] Inventors: Wypke Wypkema, Jukskei Park; Keith Anthony Jordon, Edenvale, both of South Africa

[73] Assignee: Aeci Explosives Limited, Gauteng, South Africa

[ * ] Notice: This patent issued on a continued prosecution application filed under 37 CFR 1.53(d), and is subject to the twenty year patent term provisions of 35 U.S.C. 154(a)(2).

[21] Appl. No.: 08/627,585

[22] Filed: Apr. 4, 1996

[51] Int. Cl.[6] ..... C06B 21/00

[52] U.S. Cl. ..... 149/109.6; 149/2; 149/46

[58] Field of Search ..... 149/109.6, 2, 46

[56] References Cited

U.S. PATENT DOCUMENTS

| | | | |
|---|---|---|---|
| Re. 28,848 | 6/1976 | Clay et al. | 149/2 |
| 4,008,108 | 2/1977 | Chrisp | 149/109.6 |
| 4,104,092 | 8/1978 | Mullay | 149/2 |
| 4,142,928 | 3/1979 | Stewart | 149/109.6 |
| 4,714,503 | 12/1987 | Cescon et al. | 149/109.6 |
| 4,867,813 | 9/1989 | Young | 149/109.6 |
| 4,911,770 | 3/1990 | Oliver et al. | 149/109.6 |
| 4,948,440 | 8/1990 | Cribb et al. | 149/109.6 |
| 4,992,118 | 2/1991 | Peng et al. | 149/109.6 |
| 4,994,124 | 2/1991 | Nguyen | 149/109.6 |
| 5,271,779 | 12/1993 | Engsbraten | 149/109.6 |

*Primary Examiner*—Edward A. Miller
*Attorney, Agent, or Firm*—Pillsbury Madison & Sutro LLP

[57] ABSTRACT

The invention provides a method of sensitizing a base emulsion of the water-in-oil type, and the invention provides also a sensitized emulsion explosive comprising an emulsion of the water-in-oil type when produced by the method. The method comprises dispersing, in the base emulsion, a sensitizing solution having a solvent which comprises at most 50% by mass water, the balance of the solvent being organic, and a solute which is a chemical sensitizing agent.

19 Claims, No Drawings

EXPLOSIVES

THIS INVENTION relates to an explosive. More particularly, the invention relates to a method of sensitizing a base emulsion of the water-in-oil type to provide an emulsion explosive; and to an emulsion explosive when sensitized by the method.

According to the invention there is provided a method of sensitising a base emulsion of the water-in-oil type comprising a discontinuous phase which forms an oxidising salt-containing component and a continuous phase which is immiscible with the discontinuous phase and which forms a fuel component, the method comprising dispersing, in the base emulsion, a sensitizing solution having a solvent which comprises at most 50% by mass water, the balance of the solvent being organic, and a solute which is a chemical sensitizing agent, thereby to form a sensitised emulsion explosive from the base emulsion.

In other words, according to the invention there is provided a method of sensitizing a base emulsion of the water-in-oil type (also known as the water-in-fuel type) comprising a discontinuous phase which forms an oxidizing salt-containing component and a continuous phase which is immiscible with the discontinuous phase and which forms a fuel component, the method comprising dispersing, in a base emulsion, a sensitizing solution having a solvent which is essentially organic, and a solute which is a chemical sensitizing agent.

By essentially organic is meant that the solvent contains no more than 50% by mass water, preferably no more than 25% and more preferably no more than 12%. By keeping water content at low levels, any undesirable effects of water, relating to reduced sensitivity or energy production upon detonation, can be resisted.

More particularly, the base emulsion may be a non-detonable emulsion, the solvent having a viscosity of at most 2000 cP at 20° C., the organic part of the solvent being capable of acting as a fuel constituent in the sensitised emulsion explosive formed from the base emulsion, and the solvent comprising at most 25% by mass water.

The solvent may comprise at least one organic liquid selected from the group consisting of dimethyl sulphoxide, dioxan, aliphatic amines, glycols and polymers of glycols, the solvent comprising at most 12% by mass water.

The sensitising solution may comprise at least one chemical sensitising agent selected from the group consisting of perchlorates, chlorates, nitrates, and nitrites.

The chemical sensitising agent may be a water-soluble chemical gassing agent, the organic part of the solvent being fully miscible with water and the dispersing of the sensitising solution in the base emulsion acting, by gassing the base emulsion, to reduce the density of the base emulsion at 25° C. from 1.35–1.48 g/cm$^3$ to 0.8–1.3 g/cm$^3$.

The gassing agent may be sodium nitrite, the continuous phase of the base emulsion containing a catalyst for accelerating the gassing, the sodium nitrite forming 2–20% by mass of the sensitising solution and 0.03–0.3% by mass of the sensitised emulsion explosive, and the organic part of the solution comprising at least one liquid selected from ethylene glycol and diethylene glycol. In other words, the proportions of base emulsion and sensitizing solution used may be so that, when they are mixed, the sodium nitrite forms 0.03–0.3% by mass of the emulsion explosive.

In accordance with the method of the invention the base emulsion and sensitizing solution are kept separate until use of the emulsion explosive is required, at which stage they will be homogeneously mixed. This is conveniently done by pumping them simultaneously along a hose and lance into a borehole, at the end of which lance is a static mixing device. Accordingly, the dispersing of the sensitizing solution in the base emulsion may be by pumping the base emulsion and sensitising solution along a hose into a borehole, the solution and emulsion being mixed together in a static mixing device in the borehole, the hose feeding the base emulsion and sensitizing solution to the static mixing device and the sensitized emulsion explosive emerging from the static mixing device into the borehole. The base emulsion forms a core which passes along the hose, the sensitizing solution being fed into the base so that it forms a lubricating layer around the core on the inner surface of the hose, the core and layer being mixed together as they issue from the lance into the borehole, where sensitizing takes place to provide the explosive.

According to another aspect of the invention, there is provided a sensitised emulsion explosive comprising an emulsion of the water-in-oil type having a discontinuous phase which forms an oxidising salt-containing component and a continuous phase which is immiscible with the discontinuous phase and which forms a fuel component, whenever produced by the method of the present invention as herein described.

As indicated above, the solvent may comprise a single organic liquid, or a mixture of organic liquids, and preferably has a viscosity of at most 2000 cP at 20° C., preferably at most 200 cP, the solvent being capable of acting as a fuel constituent in the eventual emulsion explosive. Examples of organic liquids suitable for use as the solvent include dimethyl sulphoxide (DMSO); dioxane; aliphatic amines, in particular diethanolamine and ethylene diamine; and glycols and polymers thereof, preferably low molecular weight glycols such as ethylene glycol and diethylene glycol.

While the sensitizing solution may contain, dissolved therein, chemical sensitizing agents which alter the oxygen balance as oxidizing agents or are explosive or high-explosive in nature, examples being perchlorates and chlorates such as sodium perchlorate and chlorate, and alkylamine nitrates such as methylamine nitrate, and hexamethylenetetramine denitrate, sugar nitrates, the chemical sensitizing agent, instead or in addition, may comprise a chemical gassing agent such as a nitrite, eg a metal nitrite such as the alkali metal nitrites or alkaline earth metal nitrites, in particular sodium nitrite. When sodium nitrite is used, the continuous phase of the base emulsion may contain catalysts such as urea, thiourea and thiocyanate dissolved therein in conventional concentrations as are used with an aqueous sodium nitrite solution, to accelerate gassing. Several chemical sensitizing agents may be used together.

When the solvent of the sensitizing solution comprises water, the water will typically be used in proportions no greater than are required to ensure effective dissolution of the chemical sensitizing agent or agents in the solvent. In this case the organic liquids in the solvent are preferably fully miscible with water in the proportions used. For this reason, when a water-soluble chemical gassing agent such as sodium nitrite is used, the solvent will preferably contain some water and the organic liquid in the solvent is conveniently a glycol such as ethylene glycol.

For safety reasons the base emulsion may be a non-detonable emulsion, for example being a non-detonable emulsion classified as such by the South African Chief Inspector of Explosives. The sensitizing solution, when dispersed in the base emulsion, sensitizes the emulsion, for example by acting via a chemical gassing agent such as sodium nitrite to reduce the density of the emulsion to render it detonable and to convert it to an emulsion explosive. Non-detonable base emulsions of the type in question which are sensitized by gassing typically have a density of 1.35–1.48 g/cm$^3$ at 25° C., before sensitizing thereof, and, after sensitizing thereof, typically provide emulsion explosives which have a density of 0.8–1.3 g/cm$^3$ at 25° C., eg 1.0–1.25 g/cm$^3$. When sodium nitrite is used as the chemical gassing agent, it may be present in the sensitizing solution in a proportion of about 2–20% by mass, preferably 5–10%.

Typically, the discontinuous phase will comprise at least one oxidizing salt selected from the group consisting of ammonium nitrate, alkali metal nitrates, alkaline earth metal nitrates, ammonium perchlorate, alkali metal perchlorates, and alkaline earth metal perchlorates.

Thus for good miscibility of the sensitizing solution with the discontinuous phase of the emulsion, organic liquids such as glycols which solvate with chlorates, perchlorates or amines (when the latter are used to sensitize the base emulsion) are conveniently employed.

The continuous phase may comprise at least one organic liquid selected from the group consisting of mineral oils, fuel oils, lubricating oils, liquid paraffins, xylene, toluene, petrolatum and dinitrotoluene, and a water-in-oil emulsifier selected from the group consisting of derivatives of polyisobutylene succinic anhydride, fatty acid esters of sorbitan, mono- and diglycerides of fat-forming fatty acids, oxazoline derivatives, alkali- and alkaline earth metal derivatives of fatty acids, soya bean lecithin, derivatives of lanolin, alkyl benzene sulphonates, oleyl acid phosphate, laurylamine acetate, decaglycerol decaoleate, decaglycerol decastearate and polymeric emulsifiers containing polyethylene backbones with fatty acid side chains. In other words, the fuel may be selected from mineral oils, fuel oils, lubricating oils, liquid paraffins, xylene, toluene, petrolatum and dinitrotoluene, or mixtures thereof; and the base emulsion will usually comprise one or more suitable water-in-oil emulsifiers, examples being derivatives of polyisobutylene succinic anhydride, fatty acid esters of sorbitan such as sorbitan sesquioleate, sorbitan monooleate, sorbitan monolaurate, sorbitan monostearate, sorbitan monopalmitate and sodium tristearate, the mono- and diglycerides of fat-forming fatty acids, oxazoline derivatives such as 2-oleyl-4-4'-bis(hydroxymethyl)-2-oxazoline, alkali- and alkaline earth metal derivatives of fatty acids, soya bean lecithin, derivatives of lanolin, alkyl benzene sulphonates, oleyl acid phosphate, laurylamine acetate, decaglycerol decaoleate, decaglycerol decastearate and polymeric emulsifiers containing polyethylene backbones with fatty acid side chains.

The fuel content of the base emulsion may be 2–12% by mass, typically 3–8%; and the emulsifier content of the base emulsion may be 0.5–2% eg 1–1.5%. The oxidizing salt-containing discontinuous phase in turn will make up the balance of the base emulsion eg 75–98% by mass thereof, typically 90–95% thereof, the oxidizing salts amounting to 70–95% by mass of the base emulsion, typically 85–93%. Ammonium nitrate usually makes up the major proportion of the oxidizing salts, forming 40–90% by mass of the base emulsion, typically 40–70%, eg 50–60%, the balance being other oxidizing salts such as calcium nitrate, which calcium nitrate in turn can form 4–70% by mass of the base emulsion, typically 15–60%, eg 15–40%. Accordingly, the fuel component may form 2–12% by mass of the base emulsion, the emulsifier forming 0.5–2% by mass of the base emulsion, and the oxidising salt-containing component forming 75–98% by mass of the base emulsion.

A conveniently used base emulsion comprises an organic fuel, an emulsifier, a discontinuous phase comprising water, ammonium nitrate and calcium nitrate and, optionally, a flame suppressant salt. Flame suppressant salts include potassium chloride, potassium sulphate, potassium dihydrogen phosphate, phosphonate salts, sodium chloride and calcium chloride. Accordingly, the base emulsion may include at least one flame suppressant salt selected from potassium chloride, potassium sulphate, potassium dihydrogen phosphate, phosphanate salts, sodium chloride and calcium chloride, the flame suppressant salt forming 0.5–15% by mass of the base emulsion. Broadly, these constituents may be present in the following proportions:

| Constituent | % by mass |
|---|---|
| Ammonium Nitrate | 40–70 |
| Calcium Nitrate | 4–70 |
| Water | 7–25 |
| Fuel | 3–8 |
| Emulsifier | 0.5–2 |
| Flame Suppressant salt | 0–15 |

More specifically, these proportions may be:

| Constituent | % by mass |
|---|---|
| Ammonium Nitrate | 50–60 |
| Calcium Nitrate | 15–40 |
| Water | 8–15 |
| Fuel | 3–8 |
| Emulsifier | 0.5–2 |
| Flame Suppressant salt | 0–8 |

When the base emulsion contains potassium chloride as the flame suppressant salt, its formulation may be:

| Constituent | % by mass |
|---|---|
| Ammonium Nitrate | 50–51 |
| Calcium Nitrate | 24–26 |
| Water | 9–12 |
| Fuel | 7–8 |
| Emulsifier | 0.5–2 |
| Potassium Chloride | 4–5 |

A conveniently used sensitizing solution comprises ethylene glycol and/or diethylene glycol as the organic liquid of the solvent, water, sodium perchlorate as a chemical sensitizing agent and sodium nitrite as a chemical gassing agent. A typical formulation of this type is:

| Constituent | % by mass |
|---|---|
| Organic Solvent Liquid | 20–40 |
| Sodium Perchlorate | 30–40 |
| Sodium Nitrite | 4–16 |
| Water | 8–40 |

More specifically, these proportions may be:

| Constituent | % by mass |
|---|---|
| Organic Solvent Liquid | 30–40 |
| Sodium Perchlorate | 35–40 |
| Sodium Nitrite | 4–9 |
| Water | 8–25 |

A particular example is:

| Constituent | % by mass |
|---|---|
| Ethylene Glycol | 40 |
| Sodium Perchlorate | 33 |
| Sodium Nitrite | 9 |
| Water | 18 |

The invention will now be described, by way of a non-limiting illustration, with reference to the following Examples.

EXAMPLE 1

A base emulsion having the following composition:

| Constituent | % by Mass |
|---|---|
| Ammonium nitrate | 71.52 |
| Water | 21.85 |
| Acetic Acid | 0.16 |
| Sodium Acetate | 0.09 |
| Thiourea | 0.38 |
| Fuel Oil Blend | 5.00 |
| Emulsifier | 1.00 |

was admixed with a sensitizing solution having the following composition:

| Constituent | % by Mass |
|---|---|
| Ethylene glycol | 35.00 |
| Sodium perchlorate | 40.00 |
| Water | 20.00 |
| Sodium Nitrite | 5.00 |

at a mixing ratio of base emulsion: sensitizing solution of 95:5, the solution had a density of 1.07 g/cm$^3$. The explosive was found to be initiable in 44 mm internal diameter PVC tubing, using a detonator containing a base charge of 760 mg pentaerythritol tetranitrate (PETN).

By contrast, in a control test using the same proportions of constituents but using the same mass of water, as is conventionally the case, as the solvent for the sodium nitrite in the sensitizing solution instead of the ethylene glycol/water mixture containing dissolved sodium perchlorate, initiation could not be obtained using the same detonator. Instead, a 30 g PENTOLITE booster available from AECI Explosives Limited in South Africa was required for initiation.

A theoretical calculation of the energies of the sensitized emulsions showed the emulsion containing the ethylene glycol/sodium perchlorate/water/sodium nitrite sensitizing solution to have 7.5% greater energy than that containing the sodium nitrite/water sensitizing solution.

EXAMPLE 2

Example 1 was repeated using the same base emulsion and sensitizing solution compositions, but the level of addition of the sensitizing solution was increased to 7:93 to provide a lower density emulsion product (0.93 g/cm$^3$).

The sensitized emulsion was initiable in a 32 mm internal diameter paper sleeve using a detonator containing a 760 mg base charge of PETN.

In a control test using the same proportions of constituents but using the same mass of water as the solvent for the sodium nitrite in the sensitizing solution instead of the ethylene glycol/water mixture containing dissolved sodium perchlorate, initiation of the sensitized emulsion could not be obtained in the same diameter cartridge with the same detonator, or even with higher strength initiators such as ANSTART (1.7 g PETN).

A theoretical calculation for the energies of the sensitized emulsions showed the emulsion containing the ethylene glycol/sodium perchlorate/water/sodium nitrite sensitizing solution to have 12.8% greater energy than that containing the sodium nitrite/water sensitizing solution.

It is to be noted with regard to the Examples that increased provision of sensitivity by the sensitizing solution relative to aqueous sodium nitrite sensitizing solutions, and more efficient mixing between the base emulsion and sensitizing solution were observed. Furthermore, it was observed that emulsion explosives sensitized in accordance with the Examples required lower pumping pressures to pump the same volumes, than those sensitized with an aqueous gassing solution similar to the control of Example 1.

It is further to be noted that larger amounts of the sensitizing solution in accordance with the present invention may be added to a base emulsion without having unacceptably detrimental effects on the energy upon detonation of the emulsion explosive. Increases in energy produced upon detonation of up to 15% have been noted, compared with the same base emulsion sensitized using an aqueous sodium nitrite sensitizing solution. Finally, higher bubble energies have been noted, increased by 5–10%, compared with the same emulsion when sensitized using the same proportion of aqueous sodium nitrite sensitizing solution, to obtain an explosive density of 1.2 g/cm$^3$.

What is claimed is:

1. A method of producing a sensitized emulsion explosive from a base emulsion wherein the base emulsion comprises (a) a discontinuous phase comprising at least one oxidizing salt and (b) a continuous phase which is immiscible with the discontinuous phase and which comprises an organic liquid fuel, said method comprising the step of dispersing a sensitizing solution in the base emulsion wherein said sensitizing solution comprises a chemical gassing agent dissolved in a solvent, said solvent comprising an organic liquid and optionally water wherein the amount of any water present in said solvent is less than 50% by mass of the solvent.

2. A method according to claim 1 wherein the amount of water present in the solvent is less than 25% by mass of the solvent.

3. A method according to claim 1 wherein the amount of water present in the solvent is less than 12% by mass of the solvent.

4. A method according to claim 1 wherein the chemical gassing agent is water-soluble.

5. A method according to claim 1 wherein the chemical gassing agent is sodium nitrite.

6. A method according to claim 1 wherein the organic liquid is selected from the group consisting of dimethyl sulfoxide, dioxan, aliphatic amines, glycols, polymers of glycols and mixtures thereof, and wherein the amount of water present in the solvent is less than 12% by mass of the solvent.

7. A method according to claim 1 wherein the organic liquid is selected from the group consisting of ethylene glycol, diethylene glycol and mixtures thereof.

8. A method according to claim 1 wherein the chemical gassing agents is sodium nitrite and the organic liquid is ethylene glycol and the amount of water present in the solvent is less than 12% by mass of the solvent.

9. A method according to claim 1 wherein the sensitizing solution further comprises an oxidizing agent.

10. A method according to claim 9 wherein said oxidizing agent is selected from the group consisting of chlorates, perchlorates, and nitrates.

11. A method according to claim 10 wherein said oxidizing agent is selected from the group consisting of sodium perchlorate, sodium chlorate and alkylamine nitrates.

12. A method according to claim 1 wherein the sensitizing solution further comprises an explosive or high explosive agent.

13. A method according to claim 1 wherein the chemical gassing agent is sodium nitrite and the continuous phase further comprises a catalyst for accelerating the gassing.

14. A method according to claim 13 wherein the catalyst is selected from the group consisting of urea, thiourea and thiocyanate.

15. A method according to claim 1 wherein the chemical sensitizing agent is a water-soluble chemical gassing agent, the organic liquid is fully miscible with water and after dispersing the sensitizing solution in the base emulsion and the gassing is complete, the density of the emulsion at 25° C. is reduced from an initial value of 1.35–1.48 g/cm$^3$ to 0.8–1.3 g/cm$^3$.

16. A method according to claim 1 wherein the chemical sensitizing agent is sodium nitrite, the continuous phase of the base emulsion contains a catalyst for accelerating gassing, the sodium nitrite is equal to from 2–20% by mass of the sensitizing solution and from 0.03–0.3% by mass of the sensitized emulsion explosive, and the organic liquid in the sensitizing solution comprises at least one liquid selected from ethylene glycol and diethylene glycol.

17. A method according to claim 1 wherein the sensitizing solution is dispersed in the base emulsion by pumping the base emulsion and sensitizing solution along a hose into a borehole, the sensitizing solution and the base emulsion being mixed together in a static mixing device and delivered into the borehole, the hose feeding the base emulsion and sensitizing solution to the static mixing device.

18. A method according to claim 17 wherein the base emulsion forms a core which passes along the hose, the sensitizing solution being fed into the hose so that it forms a lubricating layer around the core on the inner surface of the hose.

19. A method according to claim 1 wherein the discontinuous phase comprises an oxidizing salt selected from the group consisting of ammonium nitrate and a blend of ammonium nitrate and calcium nitrate; the continuous phase comprises a fuel oil and the sensitizing solution is dispersed within the base emulsion in a ratio of from 5:95 to 7:93; the gassing agent is sodium nitrite and the solvent is an ethylene glycol/water mixture wherein the ethylene glycol is present in an amount of about 35% by mass of the sensitizing solution and water is present in an amount of about 20% by mass of the sensitizing solution.

* * * * *